US010655231B2

(12) United States Patent
Takahashi et al.

(10) Patent No.: US 10,655,231 B2
(45) Date of Patent: May 19, 2020

(54) ETCHANT COMPOSITION FOR MULTILAYERED METAL FILM OF COPPER AND MOLYBDENUM, METHOD OF ETCHING USING SAID COMPOSITION, AND METHOD FOR PROLONGING LIFE OF SAID COMPOSITION

(71) Applicant: Kanto Kagaku Kabushiki Kaisha, Tokyo (JP)

(72) Inventors: Hideki Takahashi, Soka (JP); Pen-Nan Liao, Taoyuan (TW); Ying-Hao Li, Taoyuan (TW)

(73) Assignee: Kanto Kagaku Kabushiki Kaisha, Tokyo (JP)

( * ) Notice: Subject to any disclaimer, the term of this patent is extended or adjusted under 35 U.S.C. 154(b) by 7 days.

(21) Appl. No.: 15/525,817

(22) PCT Filed: Nov. 17, 2015

(86) PCT No.: PCT/JP2015/082229
§ 371 (c)(1),
(2) Date: May 10, 2017

(87) PCT Pub. No.: WO2016/080383
PCT Pub. Date: May 26, 2016

(65) Prior Publication Data

US 2018/0298500 A1 Oct. 18, 2018

(30) Foreign Application Priority Data

Nov. 18, 2014 (JP) ..... 2014-233913

(51) Int. Cl.
*C23F 1/18* (2006.01)
*C23F 1/26* (2006.01)
*C23F 1/46* (2006.01)

(52) U.S. Cl.
CPC ..... *C23F 1/18* (2013.01); *C23F 1/26* (2013.01); *C23F 1/46* (2013.01)

(58) Field of Classification Search
None
See application file for complete search history.

(56) References Cited

U.S. PATENT DOCUMENTS

2002/0081847 A1 6/2002 Jo et al.
2002/0084441 A1* 7/2002 Bernards ..... C23C 22/52 252/79.1

(Continued)

FOREIGN PATENT DOCUMENTS

CN 102102206 A 6/2011
CN 104611700 A 5/2015

(Continued)

*Primary Examiner* — Allan W. Olsen
(74) *Attorney, Agent, or Firm* — Wolf, Greenfield & Sacks, P.C.

(57) ABSTRACT

Provided is an etchant composition for a multilayered metal film comprising both a layer comprising copper and a layer comprising molybdenum, the etchant composition: being capable of etching en bloc a multilayered metal film comprising a layer constituted of copper or an alloy including copper as the main component and a layer constituted of molybdenum or an alloy including molybdenum as the main component; being effective in preventing the molybdenum layer from being undercut; making it easy to regulate the component concentrations so as to accommodate the cross-sectional shape control and cross-section; and being stable. Also provided are a method of etching using the etchant composition and a method for prolonging the life of the etchant composition. The etchant composition according to the present invention is an etchant composition for use in etching en bloc a multilayered metal film comprising a layer constituted of copper or an alloy including copper as the main component and a layer constituted of molybdenum or (Continued)

an alloy including molybdenum as the main component, and comprises hydrogen peroxide, an organic acid, an amine compound, an azole, and a hydrogen peroxide stabilizer (no inorganic acid is contained therein).

2 Claims, 3 Drawing Sheets

(56) References Cited

U.S. PATENT DOCUMENTS

| | | | | |
|---|---|---|---|---|
| 2003/0213553 | A1* | 11/2003 | Bernards | B32B 38/00 156/281 |
| 2010/0112728 | A1* | 5/2010 | Korzenski | H01L 21/02079 438/3 |
| 2011/0104840 | A1* | 5/2011 | Burdinski | B82Y 10/00 438/34 |
| 2012/0319033 | A1 | 12/2012 | Okabe et al. | |
| 2013/0048904 | A1* | 2/2013 | Adaniya | C23F 1/18 252/79.3 |
| 2014/0076461 | A1* | 3/2014 | Sparing | C23F 1/18 148/269 |
| 2014/0162403 | A1 | 6/2014 | Okabe et al. | |
| 2015/0048053 | A1* | 2/2015 | Cordonier | C03C 15/00 216/97 |
| 2016/0372276 | A1* | 12/2016 | Han | H01H 11/04 |
| 2017/0107460 | A1* | 4/2017 | Liu | C11D 3/3947 |

FOREIGN PATENT DOCUMENTS

| | | | |
|---|---|---|---|
| CN | 106255777 | A | 12/2016 |
| JP | 2002-302780 | A | 10/2002 |
| JP | 2006-111953 | A | 4/2006 |
| JP | 2013-543261 | A | 11/2013 |
| JP | 2015-209568 | A | 11/2015 |
| WO | WO 2011/099624 | A1 | 8/2011 |
| WO | WO 2013/015322 | A1 | 1/2013 |
| WO | WO 2015/162934 | A1 | 10/2015 |

* cited by examiner

[FIG. 1]
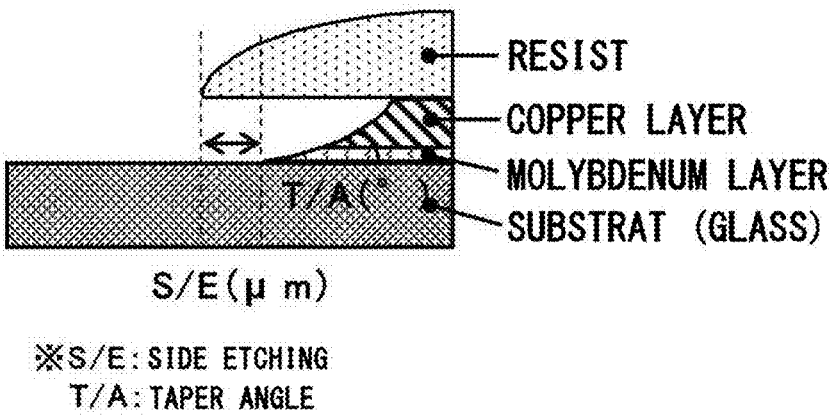
[FIG. 2]
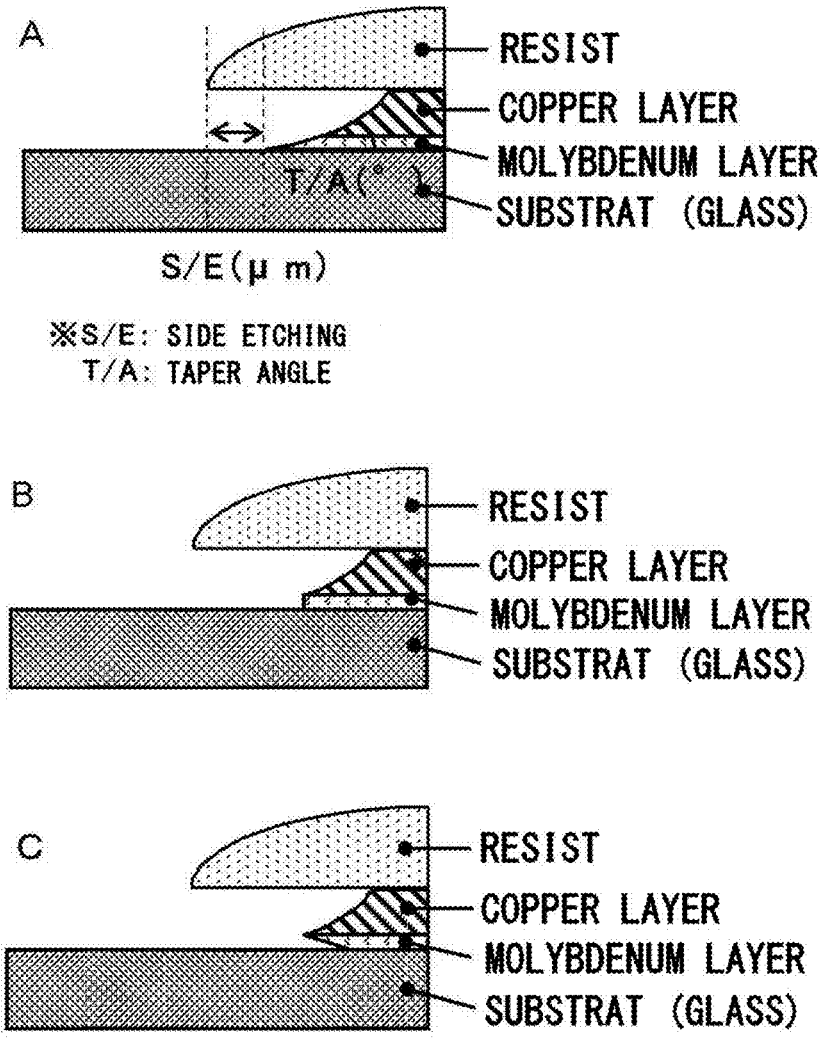

[FIG. 3]
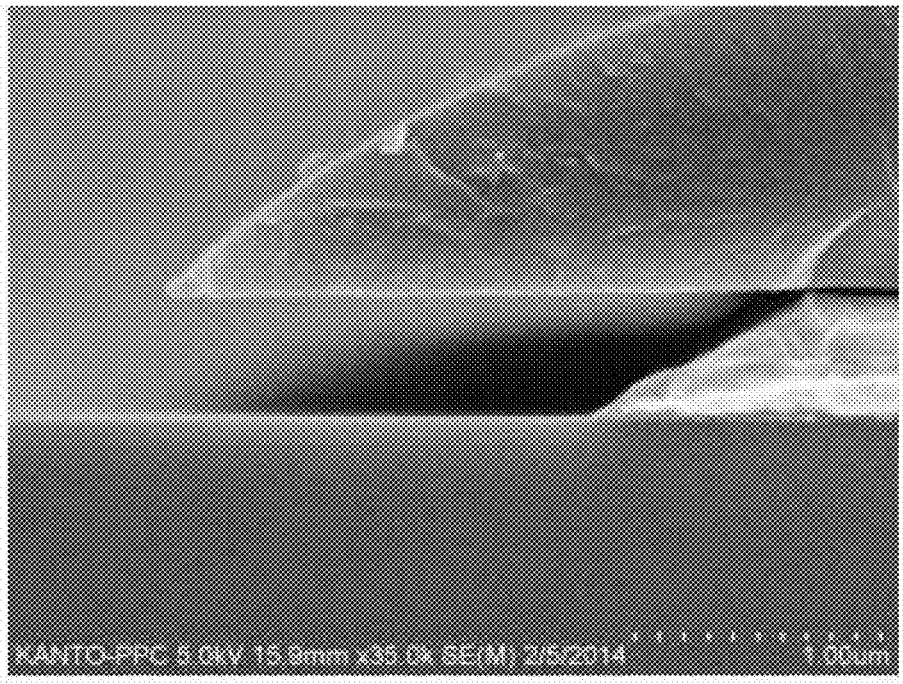
[FIG. 4]
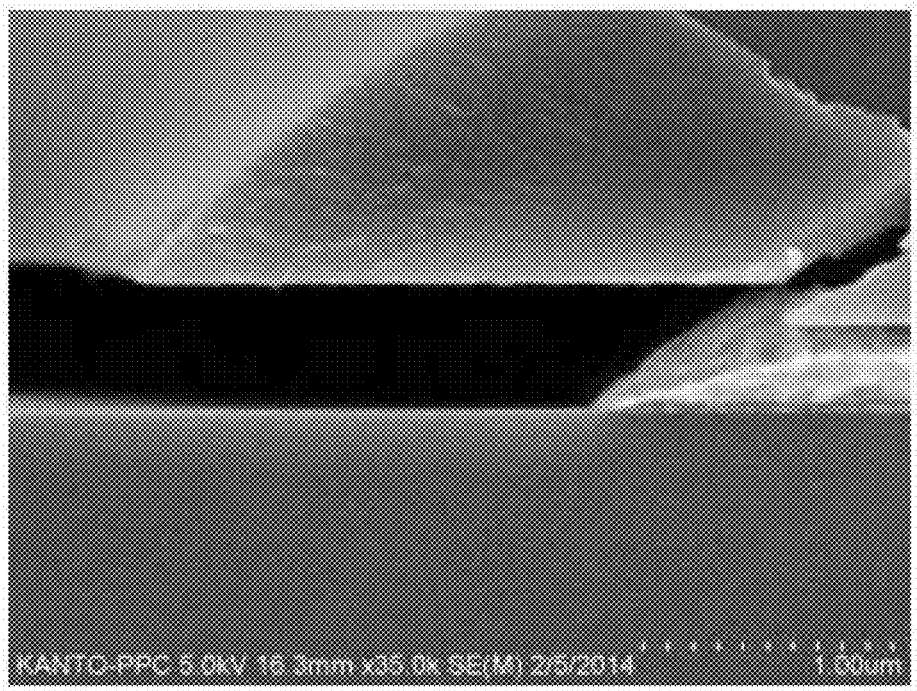

[FIG. 5]
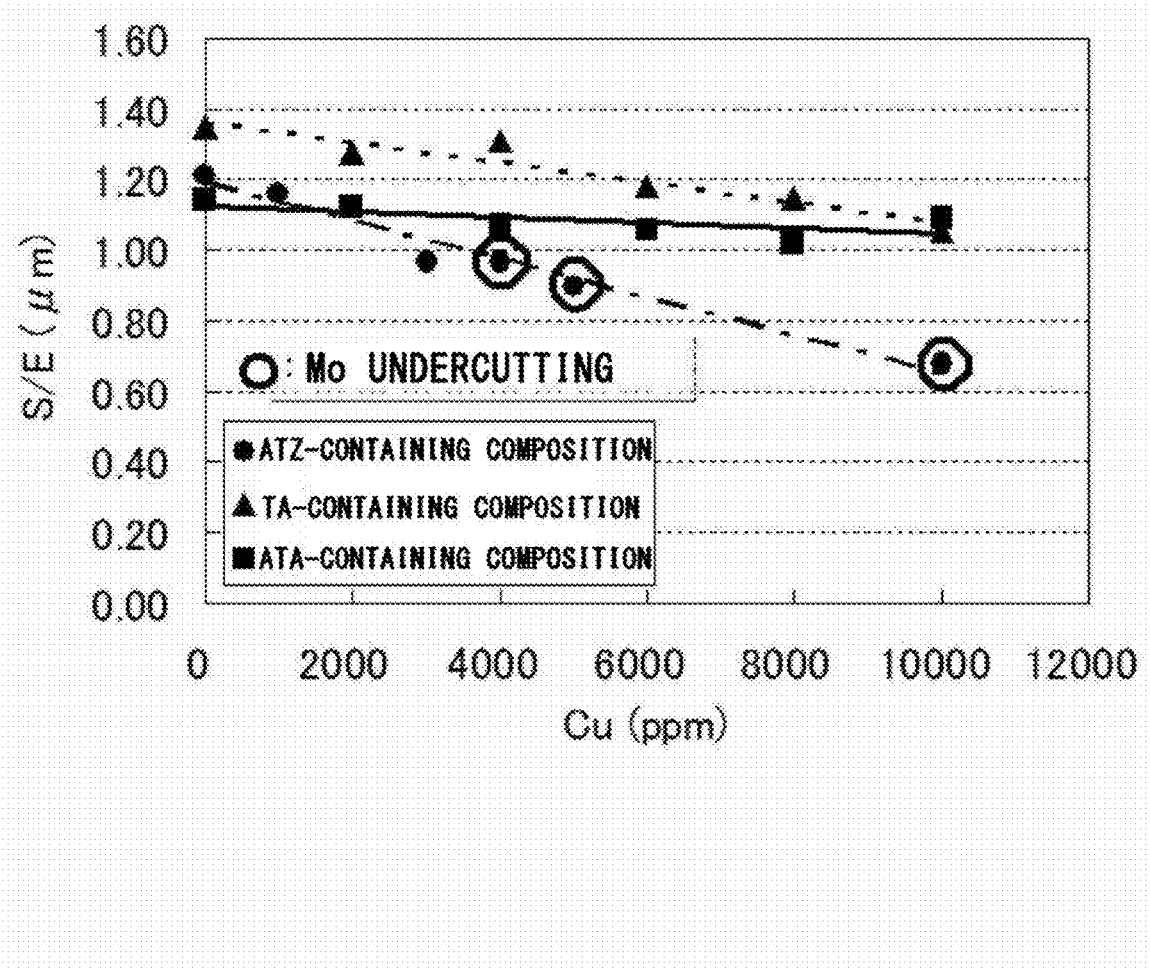

ETCHANT COMPOSITION FOR MULTILAYERED METAL FILM OF COPPER AND MOLYBDENUM, METHOD OF ETCHING USING SAID COMPOSITION, AND METHOD FOR PROLONGING LIFE OF SAID COMPOSITION

RELATED APPLICATION

This application is a national stage filing under 35 U.S.C. § 371 of International application PCT/JP2015/082229, filed Nov. 17, 2015, the disclosure of which is incorporated by reference herein in its entirety.

TECHNICAL FIELD

The present invention relates to an etching solution composition for a metal laminate film used in a flat panel display, etc., and to an etching method employing the composition.

BACKGROUND ART

Copper and copper alloys, which are materials having low resistance, have been considered as wiring materials for display devices such as flat panel displays. However, copper has the problems that adhesion to a substance such as glass is not sufficient and copper diffuses into a silicon semiconductor film. In order to improve the adhesion between a wiring material and a glass substrate and prevent diffusion into a silicon semiconductor film, providing a molybdenum layer as a barrier film has been considered.

A laminate film containing copper or a copper alloy is etched using a resist as a mask and forms a wiring or electrode pattern. With regard to the performance required for etching, the forward taper shape in terms of the angle (taper angle) formed between an etching face of a copper wiring end part and a substrate as a lower layer is 30° to 60°, and the distance (side etching) between a resist end part and a barrier film provided beneath wiring is no greater than 1.2 μm, and preferably no greater than 1 μm.

As an etching solution for a copper and molybdenum laminate film, for example, an etching solution containing hydrogen peroxide, a hydrogen peroxide stabilizing agent, and at least one selected from a neutral salt, an inorganic acid, and an organic acid (Patent Document 1), an etching solution containing hydrogen peroxide, an inorganic acid containing no fluorine atoms, an amine compound, an azole, and a hydrogen peroxide stabilizer (Patent Document 2), etc. have been proposed.

[Patent Document 1] JP, A, 2002-302780

[Patent Document 2] International Patent Application WO2011/099624

SUMMARY OF THE INVENTION

Problems to be Solved by the Invention

However, among inorganic acids, for example, sulfuric acid and nitric acid are strongly acidic and react strongly with an alkali component in an etching solution, and heat of reaction is likely to be produced. In this case, in order to suppress the decomposition of components due to a reaction with multiple components or evaporation of water content etc. due to boiling of the solution etc., it is necessary to carry out addition slowly while cooling the container, and there are problems when carrying out mass production such as it requiring a long time for preparing an etching solution.

Furthermore, hydrochloric acid, phosphoric acid, hypophosphorous acid, etc. have problems with etching performance; they greatly increase the etching rate, the taper angle becomes very high, control of the cross-sectional shape is difficult, and it is difficult to put them into practical use. Other weakly acidic inorganic acids have almost no effect on etching performance, for example, boric acid is highly toxic, and there is concern about its effect on the human body. Therefore, an etching solution containing an inorganic acid is not an etching solution that is always fully satisfactory from the viewpoint of ease of production or etching performance.

Moreover, in etching of a copper and molybdenum laminate film, in particular when the film thickness of molybdenum or a molybdenum alloy is large, molybdenum residue is likely to occur. In order to remove this, the concentration of an organic acid is important. However, if an organic acid having a high chelating effect is used, undercutting of the molybdenum layer easily occurs, whereas if the chelating effect is low, molybdenum residue occurs. Although it is possible to regulate the cross-sectional shape by using a plurality of organic acids so as to suit the film thickness of the molybdenum, in such a case the concentration of an organic acid having a weak chelating effect is high. This has the problem that, since there is a large effect on the amount of copper dissolved, the etching solution obtained has a short solution life span.

It is therefore an object of the present invention to provide an etching solution composition that, when etching a copper and molybdenum laminate film, can solve, in particular, the above problems with mass production and with the etching performance, and can control the cross-sectional shape and enable the component concentration to be easily adjusted so as to suit the cross section.

Means for Solving the Problems

While carrying out an intensive investigations in order to solve these problems, the present inventors have found that by the use of an etching solution composition containing hydrogen peroxide, an organic acid, an amine compound, an azole, and a hydrogen peroxide stabilizing agent and containing no inorganic acid, the stability of the composition improves, and by the use of an etching method employing the composition it is possible to carry out batch etching of a metal laminate film in which a copper layer is provided on a molybdenum layer; furthermore, it is possible to suppress undercutting of the molybdenum layer and control its cross-sectional shape, since a highly reactive substance having such as a strong acid is not contained and the stability is high, preparation of the composition is easy and, moreover, by the use of an etching composition further containing a phosphonic acid-based chelating agent, an alcohol-based solvent, a diol-based solvent, a triol-based solvent, a ketone-based solvent, a nitrogen-containing five-membered ring-based solvent, and/or a sulfoxide-based solvent, the above effects can be maintained and the life span of the solution can be extended.

That is, the present invention relates to

[1] An etching solution composition used in batch etching of a metal laminate film comprising a layer formed from copper or an alloy having copper as a main component and a layer formed from molybdenum or an alloy having molybdenum as a main component, the etching solution composition comprising hydrogen peroxide, an organic acid, an amine compound, an azole, and a hydrogen peroxide stabilizing agent (provided that it does not contain an inorganic acid).

[2] The etching solution composition according to [1], wherein it further comprises at least one selected from the group consisting of a phosphonic acid-based chelating agent, an alcohol-based solvent, a diol-based solvent, a triol-based solvent, a ketone-based solvent, a nitrogen-containing five-membered ring-based solvent, and a sulfoxide-based solvent.

[3] The etching solution composition according to [1] or [2], wherein the organic acid is one or more selected from alanine, glutamic acid, glycine, glycolic acid, succinic acid, cystine, aspartic acid, malic acid, malonic acid, lactic acid, and acetic acid.

[4] The etching solution composition according to any one of [1] to [3], wherein the amine compound is one or more selected from 2-amino-2-methyl-1-propanol, 1-amino-2-propanol, 2-aminoethanol, and tetramethylammonium hydroxide.

[5] The etching solution composition according to any one of [1] to [4], wherein the azole is one or more selected from 1,2,4-1H-triazole, 3-amino-1H-1,2,4-triazole, and 5-amino-1H-tetrazole.

[6] The etching solution composition according to any one of [1] to [5], wherein the hydrogen peroxide stabilizer is phenylurea.

[7] The etching solution composition according to any one of [2] to [6], wherein the phosphonic acid-based chelating agent is 1-hydroxyethane-1,1-diphosphonic acid.

[8] The etching solution composition according to any one of [2] to [6], wherein the diol-based solvent is dipropylene glycol.

[9] The etching solution composition according to any one of [1] to [8], wherein it comprises 5 to 20 mass % of hydrogen peroxide, 0.5 to 20 mass % of an organic acid, 5 to 20 mass % of an amine compound, 0.005 to 0.2 mass % of an azole, and 0.05 to 0.5 mass % of a hydrogen peroxide stabilizer.

[10] A method for batch etching a metal laminate film comprising a layer formed from copper or an alloy having copper as a main component and a layer formed from molybdenum or an alloy having molybdenum as a main component, the method comprising a step of carrying out etching using an etching solution composition comprising hydrogen peroxide, an organic acid, an amine compound, an azole, and a hydrogen peroxide stabilizing agent (provided that it does not contain an inorganic acid).

[11] The method according to [10], wherein it comprises a step of adding to the etching solution composition that has been used in etching an organic acid and at least one selected from the group consisting of a phosphonic acid-based chelating agent, an alcohol-based solvent, a diol-based solvent, a triol-based solvent, a ketone-based solvent, a nitrogen-containing five-membered ring-based solvent, and a sulfoxide-based solvent.

[12] The method according to [10] or [11], wherein it is used in a production process or a packaging process for any one of a liquid crystal display, a color film, a touch panel, an organic EL display, an electronic paper, a MEMS, and an IC.

[13] A method for extending the life span of an etching solution composition comprising hydrogen peroxide, an organic acid, an amine compound, an azole, and a hydrogen peroxide stabilizing agent (provided that it does not contain an inorganic acid), the method comprising a step of adding to the etching solution composition an organic acid and at least one selected from the group consisting of a phosphonic acid-based chelating agent, an alcohol-based solvent, a diol-based solvent, a triol-based solvent, a ketone-based solvent, a nitrogen-containing five-membered ring-based solvent, and a sulfoxide-based solvent.

Effects of the Invention

In accordance with the present invention, there can be provided an etching solution composition that enables batch etching of a metal laminate film containing a layer formed from copper or an alloy having copper as a main component and a layer formed from molybdenum or an alloy having molybdenum as a main component to be carried out, that can suppress undercutting of the molybdenum layer, and that has excellent stability, and an etching method employing the etching solution composition. Furthermore, in accordance with the present invention, a method for extending the life span of the etching composition can also be provided.

Compared with a conventional etching solution composition, the etching solution composition of the present invention can, without impairing the performance achieved by a conventional etching solution composition, avoid the problems with handling during production that occur when a strongly acidic inorganic acid such as sulfuric acid or nitric acid is used or the problems due to other inorganic acids such as phosphoric acid that are impossible to put into practical use. Furthermore, the compositional concentration of the etching solution composition of the present invention can easily be adjusted to suit the cross section. Moreover, when batch etching a metal laminate film containing a layer formed from copper and a layer formed from molybdenum, the etching method employing the etching solution composition of the present invention can suppress undercutting of the molybdenum layer compared with an etching method employing a conventional etching solution composition, and this makes control of the cross-sectional shape easy. Furthermore, due to the etching solution composition of the present invention further containing an organic acid and at least one selected from the group consisting of a phosphonic acid-based chelating agent, an alcohol-based solvent, a diol-based solvent, a triol-based solvent, a ketone-based solvent, a nitrogen-containing five-membered ring-based solvent, and a sulfoxide-based solvent, the above effects are maintained and the solubility of copper is improved, thus enabling the life span of the solution to be extended, the work involved in solution replacement and the labor cost to be cut, and the safety to be improved.

BRIEF DESCRIPTION OF DRAWINGS

FIG. 1 A schematic diagram of a cross sectional view of a Cu/Mo substrate subjected to an etching treatment with the etching solution composition of the present invention.

FIG. 2 A schematic diagram showing evaluation criteria for the state of Mo undercutting in Examples.

FIG. 3 A cross sectional view of a Cu/Mo substrate treated with the solution of Example 7.

FIG. 4 A cross sectional view of a Cu/Mo substrate treated with the solution of Example 8.

FIG. 5 A graph showing the results of side etching (S/E) in Examples 59 to 77.

MODES FOR CARRYING OUT THE INVENTION

Embodiments of the present invention are described in detail below.

A laminate film that is to be etched with the etching solution composition of the present invention is a laminate film that has a Mo or Mo alloy layer formed on a glass or silicon substrate, for example, a laminate film in which a Mo or Mo alloy layer is formed as a barrier metal on a glass substrate by a sputtering method and a Cu or Cu film is further formed thereon, examples of the composition of the laminate film including Cu/Mo, Cu/MoTi, Cu/MoFe, and Cu/MoZr.

The Mo alloy contains Mo as a main component and is an alloy containing Mo and any another metal, for example, containing at least 80 wt % of Mo, preferably at least 90 wt % of Mo, and more preferably at least 95 wt % of Mo.

Furthermore, in the present specification, Cu/Mo denotes a two-layer film in which Cu and Mo are layered in that order from the surface layer. A TFT (Thin Film Transistor) controls light by means of a flat panel display liquid crystal. The TFT includes a gate electrode and a source/drain electrode, the gate electrode being positioned in the lowest layer of the TFT, and the source/drain electrode being positioned in an upper layer. The gate electrode often has a Cu/Mo laminate film set so as to be relatively thick from the viewpoint of electrical properties, whereas the source/drain electrode is sometimes set rather thin. For example, the copper of the gate electrode is 6000 Å and the copper of the source/drain electrode is 3000 Å. It is therefore desirable to adjust the composition so as to be able to cope with either of the film thicknesses.

The film thickness of the laminate film is not particularly limited, but is preferably 1000 to 8000 Å, and more preferably 3000 to 6000 Å. The film thickness of Cu is not particularly limited, but is preferably 2000 to 7000 Å, and more preferably 3000 to 6000 Å. The film thickness of Mo or the Mo alloy is not particularly limited, but is preferably 50 to 500 Å, and more preferably 100 to 300 Å.

The etching solution composition of the present invention contains hydrogen peroxide, an organic acid, an amine compound, an azole, and a hydrogen peroxide stabilizing agent, and does not contain an inorganic acid.

The hydrogen peroxide used as an oxidizing agent in the etching solution composition of the present invention has the function of oxidizing copper wiring and has the function of oxidizing and dissolving molybdenum, the content thereof in the etching solution being preferably 5 to 20 mass %, and more preferably 5 to 10 mass %. It is preferable for the hydrogen peroxide content to be in this range since management of hydrogen peroxide is easy, an appropriate etching speed can be ensured, and control of the amount of etching becomes easy.

The organic acid used in the etching solution composition of the present invention contributes to etching of copper and molybdenum and removal of a molybdenum-derived residue, the content thereof in the etching solution composition being preferably 0.5 to 20 mass %, and more preferably 5 to 10 mass %. When the content of the organic acid is in this range, etching of copper and molybdenum and removal of a molybdenum-derived residue is carried out fully, and a good wiring cross-sectional shape can be obtained after etching. Furthermore, it also functions as a masking agent for copper ions contained after etching, thus enabling decomposition of hydrogen peroxide by copper to be suppressed.

Examples of the organic acid include an aliphatic carboxylic acid having 1 to 18 carbons, an aromatic carboxylic acid having 6 to 10 carbons, and an amino acid having 1 to 10 carbons.

Examples of the aliphatic carboxylic acid having 1 to 18 carbons include formic acid, acetic acid, propionic acid, lactic acid, glycolic acid, diglycolic acid, pyruvic acid, malonic acid, butyric acid, hydroxybutyric acid, tartaric acid, succinic acid, malic acid, maleic acid, fumaric acid, valeric acid, glutaric acid, itaconic acid, adipic acid, caproic acid, adipic acid, citric acid, propanetricarboxylic acid, trans-aconitic acid, enanthic acid, caprylic acid, lauric acid, myristic acid, palmitic acid, stearic acid, oleic acid, linoleic acid, and linolenic acid.

Examples of the aromatic carboxylic acid having 6 to 10 carbons include benzoic acid, salicylic acid, mandelic acid, phthalic acid, isophthalic acid, and terephthalic acid.

Examples of the amino acid having 1 to 10 carbons include carbamic acid, alanine, glycine, cystine, asparagine, aspartic acid, sarcosine, serine, glutamine, glutamic acid, 4-aminobutyric acid, iminodibutyric acid, arginine, leucine, isoleucine, and nitrilotriacetic acid.

Among the above organic acids, preferred examples include alanine, glutamic acid, glycine, glycolic acid, succinic acid, cystine, aspartic acid, malic acid, malonic acid, lactic acid, and acetic acid, and more preferred examples include malonic acid and succinic acid.

The amine compound used in the etching solution composition of the present invention contributes to a good wiring cross-sectional shape after etching and is a compound having 2 to 10 carbons and a total number of amino groups and hydroxy groups of two or more.

Examples of such an amine compound include polyamines such as ethylenediamine, trimethylenediamine, tetramethylenediamine, 1,2-propanediamine, 1,3-propanediamine, N,N-dimethyl-1,3-propanediamine, N,N-diethyl-1,3-propanediamine, 1,3-diaminobutane, 2,3-diaminobutane, pentamethylenediamine, 2,4-diaminopentane, hexamethylenediamine, heptamethylenediamine, octamethylenediamine, nonamethylenediamine, N-methylethylenediamine, N,N-dimethylethylenediamine, trimethylethylenediamine, N-ethylethylenediamine, N,N-diethylethylenediamine, triethylethylenediamine, 1,2,3-triaminopropane, hydrazine, tris(2-aminoethyl)amine, tetra(aminomethyl)methane, diethylenetriamine, triethylenetetramine, tetraethylpentamine, heptaethyleneoctamine, nonaethylenedecamine, and diazabicycloundecene; alkanolamines such as ethanolamine, N-methylethanolamine, N-methyldiethanolamine, N-ethylethanolamine, N-aminoethylethanolamine, N-propylethanolamine, N-butylethanolamine, diethanolamine, triethanolamine, 2-aminoethanol, 1-amino-2-propanol, N-methylisopropanolamine, N-ethylisopropanolamine, N-propylisopropanolamine, 2-aminopropan-1-ol, N-methyl-2-aminopropan-1-ol, N-ethyl-2-aminopropan-1-ol, 1-aminopropan-3-ol, N-methyl-1-aminopropan-3-ol, N-ethyl-1-aminopropan-3-ol, 1-aminobutan-2-ol, N-methyl-1-aminobutan-2-ol, N-ethyl-1-aminobutan-2-ol, 2-aminobutan-1-ol, N-methyl-2-aminobutan-1-ol, N-ethyl-2-aminobutan-1-ol, 3-aminobutan-1-ol, N-methyl-3-aminobutan-1-ol, N-ethyl-3-aminobutan-1-ol, 1-aminobutan-4-ol, N-methyl-1-aminobutan-4-ol, N-ethyl-1-aminobutan-4-ol, 1-amino-2-methylpropan-2-ol, 2-amino-2-methylpropan-1-ol, 1-aminopentan-4-ol, 2-amino-4-methylpentan-1-ol, 2-aminohexan-1-ol, 3-aminoheptan-4-ol, 1-aminooctan-2-ol, 5-aminooctan-4-ol, 2-amino-2-methyl-1-propanol, 1-aminopropane-2,3-diol, 2-aminopropane-1,3-diol, tris(oxymethyl)aminomethane, 1,2-diaminopropan-3-ol, 1,3-diaminopropan-2-ol, 2-(2-aminoethoxy)ethanol, 2-(2-aminoethylamino)ethanol, and diglycolamine; and quaternary ammonium salts such as tetramethylammonium hydroxide, and they can be used on their own or in a combination of a plurality thereof. Among the above amine compounds, preferred examples include 2-amino-2-methyl- 1-propanol, 1-amino-2-propanol, 2-aminoethanol, and tetramethylammonium hydroxide, and more preferred examples include 2-amino-2-methyl-1-propanol and 1-amino-2-propanol.

The content of the amine compound in the etching solution composition of the present invention is preferably 5 to 20 mass %, and more preferably 5 to 10 mass %. When the content of the amine compound is in this range, a good wiring cross-sectional shape can be obtained after etching.

Examples of the azole used in the etching solution composition of the present invention include triazoles such as 1,2,4-1H-triazole, 1H-benzotriazole, 5-methyl-1H-benzotriazole, and 3-amino-1H-triazole, for example 3-amino-1H-1,2,4-triazole; tetrazoles such as 1H-tetrazole, 5-methyl-1H-tetrazole, 5-phenyl-1H-tetrazole, and 5-amino-1H-tetrazole; imidazoles such as 1H-imidazole and 1H-benzoimidazole; and triazoles such as 1,3-thiazole and 4-methylthiazole. Among them, a triazole and a tetrazole are preferable, and 1,2,4-1H-triazole, 3-amino-1H-1,2,4-triazole, and 5-amino-1H-tetrazole are particularly preferable.

The content of the azole in the etching solution composition is preferably 0.005 to 0.2 mass %, and more preferably 0.01 to 0.05 mass %. When the content of the azole is in this range, a good wiring cross-sectional shape can be obtained after etching while suppressing any increase in side etching after etching.

The etching solution composition of the present invention contains a hydrogen peroxide stabilizer. Any hydrogen peroxide stabilizer may be used without limitation as long as it is one usually used as a hydrogen peroxide stabilizer, but preferred examples include urea-based hydrogen peroxide stabilizers such as phenylurea, allylurea, 1,3-dimethylurea, and thiourea and, furthermore, phenylacetamide, phenylethylene glycol, tetrasodium pyrophosphate, sodium stannate, barbituric acid, uric acid, acetanilide, oxyquinoline, salicylic acid, phenacetin, sodium silicate, an alkyldiaminetetramethylenephosphonic acid or a salt thereof, and 1,10-phenanthroline, and phenylurea is particularly preferable.

The content of the hydrogen peroxide stabilizer in the etching solution composition of the present invention is preferably 0.05 to 0.5 mass % from the viewpoint of fully obtaining the effect from the addition thereof, and more preferably 0.1 to 0.3 mass %.

The etching solution composition of the present invention does not contain an inorganic acid, and this makes it possible to avoid the problems with handling during production that occur when a strongly acidic inorganic acid such as sulfuric acid or nitric acid is used and the problems with other inorganic acids such as phosphoric acid that are difficult to put into practical use.

Since the etching solution composition of the present invention is used for etching of a substrate for which undercutting of a molybdenum layer easily occurs, the organic acid is used as an acid component, but if the etching solution composition is used continuously for a long period of time, problems occur in terms of the etching performance deteriorating accompanying an increase in the amount of copper dissolved or large amounts of bubbles being produced, the temperature increasing, and precipitates being produced due to the activity of the solution increasing. However, since the etching composition of the present invention contains at least one selected from the group consisting of a phosphonic acid-based chelating agent, an alcohol-based solvent, a diol-based solvent, a triol-based solvent, a ketone-based solvent, a nitrogen-containing five-membered ring-based solvent, and a sulfoxide-based solvent, it becomes possible to increase the amount of copper dissolved, extend the life span of the solution and, furthermore, suppress undercutting of a molybdenum layer.

Although hydrogen peroxide has the problem that it easily decomposes when metal ions are present, since a phosphonic acid-based chelating agent that is additionally contained in the etching composition of the present invention easily forms a chelate with various types of metals, and it exhibits the effects even when there is contamination with another metal, particularly when a low purity reagent is used, it becomes possible to suppress decomposition of hydrogen peroxide. Furthermore, it is surmised that the diol-based solvent and triol-based solvent additionally contained in the etching solution composition of the present invention suppress undercutting of a molybdenum layer by imparting viscosity to the etching solution composition. Moreover, the ketone-based solvent, nitrogen-containing five-membered ring-based solvent, and sulfoxide-based solvent additionally contained in the etching solution composition of the present invention suppress undercutting of a molybdenum layer due to their action in protecting the surface of molybdenum.

Examples of the phosphonic acid-based chelating agent used in the etching solution composition of the present invention include methanediphosphonic acid, 1-hydroxyethane-1,1-diphosphonic acid, 1-hydroxypropane-1,1-diphosphonic acid, aminotri(methylenephosphonic acid), ethylaminodi(methylenephosphonic acid), ethylenediaminedi(methylenephosphonic acid), ethylenediaminetetra(methylenephosphonic acid), diethylenetriaminepenta(methylenephosphonic acid), 1,2-propanediaminetetra(methylenephosphonic acid), and an ammonium salt, alkali metal salt, and organic amine salt thereof. Examples thereof further include an oxidized form of these phosphonic acid-based chelating agents that have a nitrogen atom in the molecule that has been oxidized to the N-oxide form.

Among the above phosphonic acid-based chelating compounds, 1-hydroxyethane-1,1-diphosphonic acid, 1-hydroxypropane-1,1-diphosphonic acid, and aminotri(methylenephosphonic acid) are preferable.

The content of the phosphonic acid-based chelating agent in the etching solution composition of the present invention is preferably 0.1 to 20 mass %, and more preferably 1 to 6 mass %. When in this range, the effect in suppressing Mo undercutting is easily obtained, and it is effective from the viewpoint of cost.

Examples of the alcohol-based solvent used in the etching solution composition of the present invention include monohydric alcohols such as methanol, ethanol, propanol, 2-propanol, and 1-butanol and dihydric alcohols such as ethylene glycol, propylene glycol, and butylene glycol. Examples further include a water-soluble polymer compound selected from polyethylene glycol, polypropylene glycol, and polyvinyl alcohol. One or more thereof may be used. Among them, propanol, 2-propanol, and 1-butanol are preferable, and propanol and 2-propanol are more preferable.

The content of the alcohol-based solvent in the etching solution composition of the present invention is preferably 0.1 to 50 mass %, and more preferably 2 to 10 mass %. When the content of the alcohol-based solvent is in this range, a good wiring cross-sectional shape can be obtained after etching while suppressing Mo undercutting after etching.

Examples of the diol-based solvent used in the etching solution composition of the present invention include dipropylene glycol, 1,3-propanediol, 2,3-butanediol, 1,4-butanediol, and 1,5-pentanediol. Among them, dipropylene glycol, 1,3-propanediol, 2,3-butanediol, and 1,4-butanediol are preferable, and dipropylene glycol is more preferable.

The content of the diol-based solvent in the etching solution composition of the present invention is preferably 0.1 to 50 mass %, and more preferably 2 to 10 mass %. When the content of the diol-based solvent is in this range, a good wiring cross-sectional shape can be obtained after etching while suppressing Mo undercutting after etching.

Examples of the triol-based solvent used in the etching solution composition of the present invention include glycerol.

The content of the triol-based solvent in the etching solution composition of the present invention is preferably 0.1 to 50 mass %, and more preferably 2 to 10 mass %. When the content of the triol-based solvent is in this range, a good wiring cross-sectional shape can be obtained after etching while suppressing Mo undercutting after etching.

Examples of the ketone-based solvent used in the etching solution composition of the present invention include acetone, ethyl methyl ketone, diethyl ketone, methyl propyl ketone, ethyl propyl ketone, and dipropyl ketone. Among them, acetone is preferable.

The content of the ketone-based solvent in the etching solution composition of the present invention is preferably 0.1 to 50 mass %, and more preferably 2 to 10 mass %. When the content of the ketone-based solvent is in this range, a good wiring cross-sectional shape can be obtained after etching while suppressing Mo undercutting after etching.

Examples of the nitrogen-containing five-membered ring-based solvent used in the etching solution composition of the present invention include N-methyl-2-pyrrolidinone and 2-pyrrolidinone. Among them, N-methyl-2-pyrrolidinone is preferable.

The content of the nitrogen-containing five-membered ring-based solvent in the etching solution composition is preferably 0.1 to 50 mass %, and more preferably 2 to 10 mass %. When the content of the nitrogen-containing five-membered ring-based solvent is in this range, a good wiring cross-sectional shape can be obtained after etching while suppressing Mo undercutting after etching.

Examples of the sulfoxide-based solvent used in the etching solution composition of the present invention include dimethyl sulfoxide.

The content of the sulfoxide-based solvent in the etching solution composition of the present invention is preferably 0.1 to 50 mass %, and more preferably 2 to 10 mass %. When the content of the sulfoxide-based solvent is in this range, a good wiring cross-sectional shape can be obtained after etching while suppressing Mo undercutting after etching.

The phosphonic acid-based chelating agent, the alcohol-based solvent, the diol-based solvent, the triol-based solvent, the ketone-based solvent, the nitrogen-containing five-membered ring-based solvent, and/or the sulfoxide-based solvent may be added when preparing the etching solution composition or may be added to the etching composition while it is being used for etching.

The etching solution composition of the present invention may contain, in addition to the above components, water and various types of additives that are usually used in an etching solution composition in a range that does not impair the effects of the etching solution composition. The water is preferably one from which metal ions, organic impurities, and particles have been removed by distillation, ion-exchange treatment, filter treatment, various types of adsorption treatment, etc., and pure water and ultrapure water are particularly preferable.

The etching solution composition of the present invention preferably has a pH of 3 to 6. When its pH is less than 3 or greater than 6, the hydrogen peroxide easily decomposes.

The etching method of the present invention comprises etching a metal laminate film that contains a layer formed from copper or an alloy having copper as a main component and a layer formed from molybdenum or an alloy having molybdenum as a main component using an etching solution composition that is used for etching a metal laminate film that contains a layer formed from copper or an alloy having copper as a main component and a layer formed from molybdenum or an alloy having molybdenum as a main component, the etching solution composition containing hydrogen peroxide, an organic acid, an amine compound, an azole, and a hydrogen peroxide stabilizing agent and not containing an inorganic acid, the method comprising a step of bringing an etching target and the etching solution composition of the present invention into contact. Furthermore, it has been found that in accordance with the etching method of the present invention, a metal laminate film that contains a layer formed from copper or an alloy having copper as a main component and a layer formed from molybdenum or an alloy having molybdenum as a main component can be etched as a whole, and it becomes possible to suppress undercutting of the molybdenum layer, thus enabling control of the cross-sectional shape to be easily carried out.

In the etching method of the present invention, the etching solution composition employs as an etching target one in which, as shown in for example FIG. 1, a multi-layer thin film containing a copper layer and a molybdenum layer, which is formed by layering a barrier film (the molybdenum layer) formed from a molybdenum-based material and copper wiring (the copper layer) formed from copper or a material having copper as a main component in that order on a substrate such as glass, is further coated with a resist, subjected to exposure transfer with a desired pattern mask, and developed so as to form the desired resist pattern. Here, in the present invention, the multi-layer thin film containing the copper layer and the molybdenum layer includes an embodiment in which as shown in FIG. 1 the copper layer is present on the molybdenum layer and an embodiment in which a molybdenum layer is further present on the copper layer. Furthermore, such a multi-layer thin film containing the copper layer and the molybdenum layer is one that is preferably used for wiring of a display device such as a flat panel display. Therefore, an etching target in which a copper layer is present on a molybdenum layer is a preferred embodiment from the viewpoint of the field of application.

The copper wiring is not particularly limited as long as it is formed from copper or a material having copper as a main component, and examples of the molybdenum-based material forming the barrier film include molybdenum metal and a molybdenum-based alloy.

The method for bringing the etching target into contact with the etching solution composition is not particularly limited, and a wet etching method can be employed such as for example a method in which the target is brought into contact with the etching solution composition in a manner such as dropwise addition (single wafer spin process) or spraying and a method in which the target is immersed in the etching solution composition. In the present invention, the method in which the target is brought into contact with the etching solution composition by dropwise addition thereof (single wafer spin process) and the method in which the target is immersed in the etching solution composition are preferably employed.

The temperature at which the etching solution composition is used is preferably 15° C. to 60° C., and particularly preferably 30° C. to 50° C. When the temperature of the etching solution composition is 20° C. or greater, the etching speed does not become too low, and the production efficiency does not greatly deteriorate. On the other hand, if the temperature is less than the boiling point, it is possible to suppress any change in the solution formula, thus maintaining constant etching conditions. Although the etching speed is increased by raising the temperature of the etching solution composition, an optimum treatment temperature may be determined as appropriate while taking into consideration suppression of change in the formula of the etching solution composition.

The etching solution composition usually uses a replenisher solution for the purpose of increasing the amount of copper dissolved and prolonging the use of the composition in order to cut the cost. The replenisher solution is used for replenishing the organic acid that is consumed by etching, and in the present invention the life span of the solution can be greatly extended by adding to the etching solution composition as the replenisher solution the organic acid used in the etching solution composition of the present invention and at least one selected from the group consisting of a phosphonic acid-based chelating agent, an alcohol-based solvent, a diol-based solvent, a triol-based solvent, a ketone-based solvent, a nitrogen-containing five-membered ring-based solvent, and a sulfoxide-based solvent rather than a case in which only the organic acid is used as the replenisher solution.

The amount of organic acid added as the replenisher solution is preferably 0.1 to 10 mass % relative to 100 mass % of the etching solution composition, and more preferably 0.1 to 5 mass %. The amount of phosphonic acid-based chelating agent, alcohol-based solvent, diol-based solvent, triol-based solvent, ketone-based solvent, nitrogen-containing five-membered ring-based solvent, and/or sulfoxide-based solvent added as the replenisher solution is preferably 0.1 to 20 mass % relative to 100 mass % of the etching solution composition, and more preferably 2 to 10 mass %.

EXAMPLES

The present invention is further specifically explained below by way of Examples and Comparative Examples, but the present invention should not be construed as being limited to these Examples and may be modified in a variety of ways as long as the modifications do not depart from the technical scope of the present invention.

[Preparation of Copper/Molybdenum Substrate]

A copper/molybdenum-based multi-layer thin film was prepared by forming a barrier film of molybdenum (Mo) using glass as a substrate and sputtering molybdenum, then forming copper wiring by sputtering copper, then coating it with a resist, and forming a pattern by exposure transfer through a pattern mask and developing.

The Cu film thickness and the Mo film thickness of the substrates used in each of the Examples and Comparative Examples are shown in Tables 1 to 5 and 12 to 14.

Examples 1 and 2

Etching Test

The etching solution compositions shown in Table 1 were each placed in a beaker, and the temperature was stabilized in a thermostatted chamber kept at 35° C. While stirring the etching solution composition with a stirrer, a 1×1 cm copper/molybdenum substrate was immersed therein, and the etching time was measured. The etching time measured when copper and molybdenum disappeared was defined as the just-etching time, and a time that was about twice the just-etching time was defined as the actual etching time (over-etching time). In Examples 1 and 2, etching was carried out by defining a time that was twice the just-etching time given in Table 1 as the over-etching time; after a treatment involving washing with water and drying, the cross-sectional shape was examined by SEM, and the performance was evaluated in terms of the amount of side etching, the taper angle, Mo residue, Mo undercutting, etc.

Each of the terms is explained using FIG. 1. Side etching denotes the length from the resist end part to the etched metal end part, taper angle is the angle formed between an etching face of a copper wiring part and a metal as a lower layer, Mo residue is residual Mo that has not dissolved after etching, and Mo undercutting is a shape in which the Mo layer has been etched more than the Cu layer.

The results are shown in Table 1. With regard to the designations A to C used for the Mo residue in the table, A is very good, B is good, and C is poor. With regard to the designations A to C in FIG. 2 denoting the state of Mo undercutting, A is very good, B is good, and C is poor. With regard to the designations A and C denoting the solubility of copper, A is good and C is poor, poor meaning a state in which there is residue that has not been dissolved.

TABLE 1

| | | Example 1 | Example 2 |
|---|---|---|---|
| (A) | Hydrogen peroxide (wt %) | 10 | 10 |
| (B) | Malonic acid (wt %) | 5 | 5 |
| | Succinic acid (wt %) | 5 | 9 |
| (C) | MIPA (wt %) | 10 | 10.5 |
| (D) | ATZ (wt %) | 0.01 | 0.01 |
| (E) | Phenylurea (wt %) | 0.5 | 0.5 |
| (F) | HEDP (wt %) | — | — |
| | Water | Remainder | Remainder |
| | Copper powder (ppm) | — | — |
| | pH | 4.6 | 4.4 |
| | Cu film thickness/Mo film thickness (Å/Å) | 5500/200 | 5500/200 |
| | JET (sec) | 62 | 71 |
| | S/E (μm) | 1.48 | 1.50 |
| | T/A (°) | 34 | 32 |
| | Mo residue | A | A |
| | Mo undercutting | A | A |

MIPA: 1-amino-2-propanol
ATZ: 5-amino-1H-tetrazole
HEDP: 1-hydroxyethane-1,1-diphosphonic acid
JET: just-etching time
S/E: side etching
T/A: taper angle It can be seen from Table 1 that the etching solution composition of the present invention, which does not contain an inorganic acid, suppresses Mo undercutting without containing an inorganic acid.

Examples 3 to 8

Etching Test

Etching was carried out in the same way as for Example 1 except that the etching solution compositions shown in Table 2 and substrates having the Mo film thicknesses shown in Table 2 were used, the over-etching time being twice the just-etching time.

The results are shown in Table 2 and FIGS. 3 and 4.

TABLE 2

| | Example 3 | Example 4 | Example 5 | Example 6 | Example 7 | Example 8 |
|---|---|---|---|---|---|---|
| (A) Hydrogen peroxide (wt %) | 10 | 10 | 10 | 10 | 10 | 10 |
| (B) Malonic acid (wt %) | 2 | 2 | 2 | 2 | 2 | 2 |
| Succinic acid (wt %) | 8 | 8 | 8 | 8 | 8 | 8 |
| (C) MIPA (wt %) | 8 | 8 | 8 | 8 | 8 | 8 |
| (D) ATZ (wt %) | 0.01 | 0.01 | 0.01 | 0.01 | 0.01 | 0.01 |
| (E) Phenylurea (wt %) | 0.5 | 0.5 | 0.5 | 0.5 | 0.5 | 0.5 |
| (F) HEDP (wt %) | 3.0 | 3.5 | 4.0 | 3.0 | 3.5 | 4.0 |
| Water | Remainder | Remainder | Remainder | Remainder | Remainder | Remainder |
| Copper powder (ppm) | — | — | — | — | — | — |
| pH | 4.2 | 4.2 | 4.1 | 4.2 | 4.2 | 4.1 |
| Cu film thickness/Mo film thickness (Å/Å) | 5000/140 | 5000/140 | 5000/140 | 5000/280 | 5000/280 | 5000/280 |
| JET (sec) | 70 | 70 | 69 | 75 | 75 | 75 |
| S/E (μm) | 1.40 | 1.48 | 1.60 | 1.67 | 1.66 | 1.78 |
| T/A (°) | 29 | 28 | 31 | 30 | 29 | 33 |
| Mo residue | A | A | A | A | A | A |
| Mo undercutting | B | A | A | B | A | A |

It is clear that Mo undercutting is suppressed in response to an increase in the amount of 1-hydroxyethane-1,1-diphosphonic acid (HEDP) added. Furthermore, it is clear that Mo undercutting can be suppressed not only for a substrate having a Mo film thickness of 140 Å but also for a substrate having a film thickness of 280 Å.

Examples 9 to 20

Etching Test

Etching was carried out in the same way as for Example 1 except that the amount of copper powder shown in Tables 3 and 4 was dissolved in an etching solution composition having the pH shown in Tables 3 and 4, the over-etching time being 124 seconds for Examples 9 and 11 to 13 and 142 seconds for Examples 10 and 14 to 20.

The results are shown in Tables 3 and 4.

TABLE 3

| | Example 9 | Example 10 | Example 11 | Example 12 | Example 13 |
|---|---|---|---|---|---|
| (A) Hydrogen peroxide (wt %) | 10 | 10 | 10 | 10 | 10 |
| (B) Malonic acid (wt %) | 5 | 5 | 7 | 8 | 9 |
| Succinic acid (wt %) | 5 | 9 | 5 | 5 | 5 |
| (C) MIPA (wt %) | 10 | 10.5 | 10 | 10 | 10 |
| (D) ATZ (wt %) | 0.01 | 0.01 | 0.01 | 0.01 | 0.01 |
| (E) Phenylurea (wt %) | 0.5 | 0.5 | 0.5 | 0.5 | 0.5 |
| (F) HEDP (wt %) | — | — | — | — | — |
| Water | Remainder | Remainder | Remainder | Remainder | Remainder |
| Copper powder (ppm) | 8000 | 8000 | 8000 | 8000 | 8000 |
| pH | 4.6 | 4.5 | 4.1 | 3.9 | 3.7 |
| Cu film thickness/Mo film thickness (Å/Å) | 5500/200 | 5500/200 | 5500/200 | 5500/200 | 5500/200 |
| JET (sec) | 80 | 86 | 60 | 60 | 45 |
| S/E (μm) | 0.87 | 1.04 | 1.38 | 1.65 | 1.87 |
| T/A (°) | 42 | 34 | 47 | 43 | 44 |
| Mo residue | A | A | A | A | A |
| Mo undercutting | C | C | C | C | C |

TABLE 4

| | Example 14 | Example 15 | Example 16 | Example 17 | Example 18 | Example 19 | Example 20 |
|---|---|---|---|---|---|---|---|
| (A) Hydrogen peroxide (wt %) | 10 | 10 | 10 | 10 | 10 | 10 | 10 |
| (B) Malonic acid (wt %) | 5 | 5 | 5 | 5 | 5 | 5 | 5 |
| Succinic acid (wt %) | 9 | 9 | 9 | 9 | 9 | 9 | 9 |

TABLE 4-continued

| | Example 14 | Example 15 | Example 16 | Example 17 | Example 18 | Example 19 | Example 20 |
|---|---|---|---|---|---|---|---|
| (C) MIPA (wt %) | 10.5 | 10.5 | 10.5 | 10.5 | 10.5 | 10.5 | 10.5 |
| (D) ATZ (wt %) | 0.01 | 0.01 | 0.01 | 0.01 | 0.01 | 0.01 | 0.01 |
| (E) Phenylurea (wt %) | 0.5 | 0.5 | 0.5 | 0.5 | 0.5 | 0.5 | 0.5 |
| (F) HEDP (wt %) | 1.0 | 1.5 | 2.0 | 2.5 | 3.6 | 4.3 | 5.8 |
| Water | Remainder | Remainder | Remainder | Remainder | Remainder | Remainder | Remainder |
| Copper powder (ppm) | 8000 | 8000 | 8000 | 8000 | 8000 | 8000 | 8000 |
| pH | 4.4 | 4.3 | 4.3 | 4.3 | 4.1 | 4.0 | 3.8 |
| Cu film thickness/Mo film thickness (Å/Å) | 5500/200 | 5500/200 | 5500/200 | 5500/200 | 5500/200 | 5500/200 | 5500/200 |
| JET (sec) | 80 | 80 | 80 | 75 | 70 | 65 | 51 |
| S/E (μm) | 1.17 | 1.01 | 1.12 | 1.00 | 1.33 | 1.27 | 1.04 |
| T/A (°) | 34 | 35 | 36 | 36 | 40 | 44 | 49 |
| Mo residue | A | A | A | A | A | A | A |
| Mo undercutting | B | B | A | A | A | A | A |

It is clear that the etching solution composition containing hydrogen peroxide, malonic acid, succinic acid, 1-amino-2-propanol (MIPA), 5-amino-1H-tetrazole (ATZ), and phenylurea exhibited the same Mo residue as for Examples 1 and 2 regardless of pH in a state in which copper was dissolved as in Examples 9 to 13, but more Mo undercutting occurred than in Examples 1 and 2.

Furthermore, the etching solution composition containing a larger amount of HEDP does not produce Mo undercutting even in a state in which copper is dissolved as in Examples 14 to 20. In particular, since HEDP is acidic, its addition decreases the pH, and when the pH becomes too low, Mo undercutting sometimes occurs, but it is clear that Mo undercutting does not occur regardless of the pH decreasing in response to an increase in the amount of HEDP. It is clear from this result that the life span of the solution can be extended by adding HEDP as a replenisher solution to an etching solution composition that has been used for treating a large amount of substrate.

Examples 21 to 28

Copper Solubility Test

The amount of copper powder shown in Table 5 was dissolved in the etching solution composition shown in Table 5, and the copper solubility in the etching composition was tested. In the test, the etching solution composition shown in Table 5 was placed in a beaker, the copper powder was added thereto while stirring with a stirrer, and the state of the solution was examined.

The results are shown in Table 5.

The etching solution composition containing hydrogen peroxide, malonic acid, succinic acid, MIPA, ATZ, and phenylurea exhibited the same solubility for copper as in Examples 1 and 2 in a state in which copper was dissolved at 1000 ppm or 2000 ppm as in Examples 21 and 22; on the other hand, in a state in which copper was dissolved at 3000 ppm or 4000 ppm as in Examples 23 and 24, the solubility for copper was insufficient, the occurrence of bubbles or a precipitate was observed, and it is therefore clear that the etching solution composition of the present invention can withstand treatment of a predetermined amount of substrate.

Furthermore, the etching solution compositions further containing HEDP exhibited the same solubility for copper as in Examples 1 and 2 even in a state in which copper was dissolved at 6000 ppm, 8000 ppm, or 10000 ppm as in Examples 25 to 27, whereas in a state in which copper was dissolved at 12000 ppm as in Example 28, the solubility for copper was insufficient, the occurrence of a precipitate was observed, and it is therefore clear that the etching solution composition of the present invention can further withstand treatment of a larger amount of substrate due to it containing HEDP. That is, it is clear from this result that the life span of the solution can be extended by adding HEDP as a replenisher solution to an etching solution composition that has been used for treating a large amount of substrate or when preparing the etching solution composition.

TABLE 5

| | Example 21 | Example 22 | Example 23 | Example 24 | Example 25 | Example 26 | Example 27 | Example 28 |
|---|---|---|---|---|---|---|---|---|
| (A) Hydrogen peroxide (wt %) | 8 | 8 | 8 | 8 | 8 | 8 | 8 | 8 |
| (B) Malonic acid (wt %) | 1 | 1 | 1 | 1 | 1 | 1 | 1 | 1 |
| Succinic acid (wt %) | 9 | 9 | 9 | 9 | 9 | 9 | 9 | 9 |
| (C) MIPA (wt %) | 8 | 8 | 8 | 8 | 8 | 8 | 8 | 8 |
| (D) ATZ (wt %) | 0.01 | 0.01 | 0.01 | 0.01 | 0.01 | 0.01 | 0.01 | 0.01 |
| (E) Phenylurea (wt %) | 0.1 | 0.1 | 0.1 | 0.1 | 0.1 | 0.1 | 0.1 | 0.1 |
| (F) HEDP (wt %) | — | — | — | — | 2 | 2 | 2 | 2 |
| Water | Remainder | Remainder | Remainder | Remainder | Remainder | Remainder | Remainder | Remainder |
| Copper powder (ppm) | 1000 | 2000 | 3000 | 4000 | 6000 | 8000 | 10000 | 12000 |
| Copper solubility | A | A | C | C | A | A | A | C |
| Solution state | — | — | Large amount of bubbles produced | Precipitate produced | — | — | — | Precipitate produced |

Examples 29 to 58 and Comparative Examples 1 to 20

Replenisher Solution Test

Examples 29 to 58

The etching solution compositions shown in Table 6 were placed in beakers and the temperature was stabilized in a thermostatted chamber kept at 35° C. Copper powder was added at 10000 ppm to the beaker with the etching solution composition and completely dissolved therein, and the vol % given in Tables 7 to 10 relative to 100 vol % of the etching solution composition of a 40 wt % aqueous solution of malonic acid (remainder was water) (replenisher solution A), an alcohol-based solvent (isopropyl alcohol (IPA)), a diol-based solvent (dipropylene glycol (DPG)), a triol-based solvent (glycerol), a ketone-based solvent (acetone), a nitrogen-containing five-membered ring-based solvent (N-methyl-2-pyrrolidinone (NMP)), or a sulfoxide-based solvent (dimethyl sulfoxide (DMSO)) 100 wt % (replenisher solution B) was added. While stirring the etching solution composition with a stirrer, a 1×1 cm copper/molybdenum substrate (Cu film thickness/Mo film thickness=5500/300) was immersed therein, and the etching time was measured. Etching was carried out with an over-etching time of 144 seconds, which was twice the just-etching time (77 seconds) of the etching solution composition shown in Table 6 to which the copper powder and the replenisher solution were not added; after a treatment involving washing with water and drying, the cross-sectional shape was examined by SEM, and the performance was evaluated from the amount of side etching, the taper angle, Mo residue, Mo undercutting, etc.

The results are shown in Tables 7 to 9.

Comparative Examples 1 to 20

Etching solution compositions were prepared in the same way as above except that the amount of copper powder was set to that shown in Tables 10 and 11 and replenisher solutions A and B were used, and etching was carried out. The results are shown in Tables 10 and 11.

TABLE 6

| | | |
|---|---|---|
| (A) | Hydrogen peroxide (wt %) | 10 |
| (B) | Malonic acid (wt %) | 5 |
| | Succinic acid (wt %) | 5 |
| (C) | MIPA (wt %) | 10 |
| (D) | ATZ (wt %) | 0.02 |
| (E) | Phenylurea (wt %) | 0.3 |
| | Water | Remainder |

TABLE 7

| | | Example 29 | Example 30 | Example 31 | Example 32 | Example 33 | Example 34 | Example 35 | Example 36 | Example 37 | Example 38 |
|---|---|---|---|---|---|---|---|---|---|---|---|
| Copper powder (ppm) | | 10000 | 10000 | 10000 | 10000 | 10000 | 10000 | 10000 | 10000 | 10000 | 10000 |
| Replenisher solution A | Amt. added (vol %) | 4 | 4 | 4 | 4 | 4 | 4 | 4 | 4 | 4 | 4 |
| Replenisher solution B | Type | DPG | DPG | DPG | DPG | DPG | IPA | IPA | IPA | IPA | IPA |
| | Amt. added (vol %) | 2 | 4 | 6 | 8 | 10 | 2 | 4 | 6 | 8 | 10 |
| JET (sec) | | 80 | 80 | 80 | 80 | 80 | 80 | 80 | 80 | 80 | 80 |
| S/E (μm) | | 1.41 | 1.37 | 1.31 | 1.29 | 1.19 | 1.31 | 1.27 | 1.18 | 1.19 | 1.26 |
| T/A (°) | | 50 | 50 | 46 | 48 | 47 | 52 | 52 | 50 | 48 | 43 |
| Mo residue | | A | A | A | A | A | A | A | A | A | A |
| Mo undercutting | | B | A | A | A | A | B | B | A | A | A |
| pH | | 4.3 | 4.3 | 4.3 | 4.3 | 4.3 | 4.3 | 4.3 | 4.4 | 4.4 | 4.4 |

DPG: dipropylene glycol

IPA: isopropyl alcohol

TABLE 8

| | | Example 39 | Example 40 | Example 41 | Example 42 | Example 43 | Example 44 | Example 45 | Example 46 | Example 47 | Example 48 |
|---|---|---|---|---|---|---|---|---|---|---|---|
| Copper powder (ppm) | | 10000 | 10000 | 10000 | 10000 | 10000 | 10000 | 10000 | 10000 | 10000 | 10000 |
| Replenisher solution A | Amt. added (vol %) | 4 | 4 | 4 | 4 | 4 | 4 | 4 | 4 | 4 | 4 |
| Replenisher solution B | Type | Glycerol | Glycerol | Glycerol | Glycerol | Glycerol | Acetone | Acetone | Acetone | Acetone | Acetone |
| | Amt. added (vol %) | 2 | 4 | 6 | 8 | 10 | 2 | 4 | 6 | 8 | 10 |
| JET (sec) | | 80 | 80 | 80 | 80 | 80 | 80 | 80 | 80 | 80 | 80 |
| S/E (μm) | | 1.41 | 1.38 | 1.28 | 1.24 | 1.22 | 1.44 | 1.38 | 1.27 | 0.97 | 0.92 |
| T/A (°) | | 52 | 52 | 53 | 52 | 54 | 56 | 51 | 52 | 48 | 27 |
| Mo residue | | A | A | A | A | A | A | A | A | A | A |
| Mo undercutting | | B | A | A | A | A | B | B | A | A | A |
| pH | | 4.2 | 4.2 | 4.2 | 4.2 | 4.2 | 4.2 | 4.3 | 4.3 | 4.4 | 4.4 |

TABLE 9

| | | Example 49 | Example 50 | Example 51 | Example 52 | Example 53 | Example 54 | Example 55 | Example 56 | Example 57 | Example 58 |
|---|---|---|---|---|---|---|---|---|---|---|---|
| Copper powder (ppm) | | 10000 | 10000 | 10000 | 10000 | 10000 | 10000 | 10000 | 10000 | 10000 | 10000 |
| Replenisher solution A | Amt. added (vol %) | 4 | 4 | 4 | 4 | 4 | 4 | 4 | 4 | 4 | 4 |
| Replenisher solution B | Type | NMP | NMP | NMP | NMP | NMP | DMSO | DMSO | DMSO | DMSO | DMSO |
| | Amt. added (vol %) | 2 | 4 | 6 | 8 | 10 | 2 | 4 | 6 | 8 | 10 |
| JET (sec) | | 80 | 80 | 80 | 80 | 80 | 80 | 80 | 80 | 80 | 80 |
| S/E (μm) | | 1.38 | 1.28 | 1.26 | 1.25 | 1.21 | 1.36 | 1.45 | 1.31 | 1.22 | 1.16 |
| T/A (°) | | 53 | 52 | 54 | 57 | 51 | 52 | 53 | 56 | 51 | 52 |
| Mo residue | | A | A | A | A | A | A | A | A | A | A |
| Mo undercutting | | B | B | B | A | A | B | B | B | A | A |
| pH | | 4.3 | 4.3 | 4.4 | 4.4 | 4.4 | 4.3 | 4.3 | 4.4 | 4.4 | 4.4 |

NMP: N-methyl-2-pyrrolidinone
DMSO: dimethyl sulfoxide

TABLE 10

| | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 | Comp. Ex. 10 |
|---|---|---|---|---|---|---|---|---|---|---|---|
| Copper powder (ppm) | | — | 10000 | 10000 | 10000 | 10000 | 10000 | 10000 | 10000 | 10000 | 10000 |
| Replenisher solution A | Amt. added (vol %) | — | — | 2 | 3 | 4 | 5 | 6 | 7 | 8 | 9 |
| Replenisher solution B | Type | — | — | — | — | — | — | — | — | — | — |
| | Amt. added (vol %) | — | — | — | — | — | — | — | — | — | — |
| JET (sec) | | 77 | 93 | 95 | 90 | 85 | 83 | 80 | 76 | 75 | 75 |
| S/E (μm) | | 1.08 | 1.07 | 1.06 | 1.03 | 1.15 | 1.20 | 1.25 | 1.30 | 1.32 | 1.34 |
| T/A (°) | | 40 | 42 | 43 | 42 | 50 | 51 | 52 | 54 | 53 | 58 |
| Mo residue | | A | A | A | A | A | A | A | A | A | A |
| Mo undercutting | | B | C | C | C | C | A | B | B | B | B |
| pH | | 4.4 | 4.5 | 4.5 | 4.5 | 4.4 | 4.4 | 4.3 | 4.3 | 4.2 | 4.2 |

TABLE 11

| | | Comp. Ex. 11 | Comp. Ex. 12 | Comp. Ex. 13 | Comp. Ex. 14 | Comp. Ex. 15 | Comp. Ex. 16 | Comp. Ex. 17 | Comp. Ex. 18 | Comp. Ex. 19 | Comp. Ex. 20 |
|---|---|---|---|---|---|---|---|---|---|---|---|
| Copper powder (ppm) | | 10000 | 10000 | 10000 | 10000 | 10000 | 10000 | 10000 | 10000 | 10000 | 10000 |
| Replenisher solution A | Amt. added (vol %) | 4 | 4 | 4 | 4 | 4 | 4 | 4 | 4 | 4 | 4 |
| Replenisher solution B | Type | BDG | BDG | Lactic acid | Lactic acid | Lactic acid | Lactic acid | Lactic acid | MEA | MEA | MEA |
| | Amt. added (vol %) | 2 | 4 | 2 | 4 | 6 | 8 | 10 | 2 | 4 | 6 |
| JET (sec) | | 80 | Measurement not possible due to resist peel off | 80 | 80 | 80 | 80 | 80 | 80 | 80 | Temp increased and large amount of bubbles produced |
| S/E (μm) | | 1.41 | | 1.51 | 1.57 | 1.72 | 1.83 | 1.83 | 1.42 | 1.31 | |
| T/A (°) | | 52 | | 58 | 49 | 53 | 53 | 55 | 52 | 64 | |
| Mo residue | | A | | A | A | A | A | A | A | A | |
| Mo undercutting | | A | | C | C | C | C | C | C | C | |
| pH | | 4.2 | 4.2 | 4.0 | 3.7 | 3.6 | 3.4 | 3.3 | 4.8 | 5.4 | 6.0 |

BDG: butyl diglycol
MEA: monoethanolamine

As shown in Tables 7 to 9, when an organic acid and a diol-based solvent, an alcohol-based solvent, a triol-based solvent, a ketone-based solvent, a nitrogen-containing five-membered ring-based solvent, or a sulfoxide-based solvent were added as a replenisher solution, compared with a case in which only an organic acid was added as a replenisher solution, the effect in suppressing Mo undercutting was large. Furthermore, the use of an organic acid and each of the above solvents as a replenisher solution was effective for Mo undercutting, but the use of a glycol ether-based solvent (butyl diglycol (BDG)), a carboxylic acid-based solvent (lactic acid), or an amine-based solvent (monoethanolamine (MEA)) as a replenisher solution was not effective for Mo undercutting (Tables 10 and 11). Therefore, it has been found that the diol-based solvent, the alcohol-based solvent, the triol-based solvent, the ketone-based solvent, the nitrogen-containing five-membered ring-based solvent, and the sulfoxide-based solvent have an effect in suppressing Mo undercutting. The above solvents are effective not only as a replenisher solution but also when added during preparation of the etching solution composition.

Examples 59 to 77

Etching Test

Etching was carried out in the same way as for Example 1 except that the amount of copper powder shown in Tables 12 to 14 was dissolved in the etching solution composition containing the amine compound and azole compound shown in Tables 12 to 14, and a substrate having the Mo film thickness shown in Tables 12 to 14 was used, the over-etching time being 131 seconds for Examples 59 to 65 and 119 seconds for Examples 66 to 77 (each being 1.7 times when the just-etching time prior to dissolution of copper was defined as a reference).

The results are shown in Tables 12 to 14 and FIG. 5.

TABLE 12

| | Example 59 | Example 60 | Example 61 | Example 62 | Example 63 | Example 64 | Example 65 |
|---|---|---|---|---|---|---|---|
| (A) Hydrogen peroxide (wt %) | 10 | 10 | 10 | 10 | 10 | 10 | 10 |
| (B) Malonic acid (wt %) | 5 | 5 | 5 | 5 | 5 | 5 | 5 |
| Succinic acid (wt %) | 5 | 5 | 5 | 5 | 5 | 5 | 5 |
| (C) AMP (wt %) | 10 | 10 | 10 | 10 | 10 | 10 | 10 |
| (D) ATZ (wt %) | 0.02 | 0.02 | 0.02 | 0.02 | 0.02 | 0.02 | 0.02 |
| (E) Phenylurea (wt %) | 0.3 | 0.3 | 0.3 | 0.3 | 0.3 | 0.3 | 0.3 |
| Water | Remainder | Remainder | Remainder | Remainder | Remainder | Remainder | Remainder |
| Copper powder (ppm) | 0 | 1000 | 2000 | 3000 | 4000 | 5000 | 10000 |
| pH | 4.4 | 4.5 | 4.5 | 4.5 | 4.6 | 4.6 | 4.6 |
| Cu film thickness/Mo film thickness (Å/Å) | 5500/300 | 5500/300 | 5500/300 | 5500/300 | 5500/300 | 5500/300 | 5500/300 |
| JET (sec) | 77 | 81 | 85 | 88 | 89 | 95 | 100 |
| S/E (μm) | 1.50 | 1.50 | 1.47 | 1.36 | 1.32 | 1.27 | 1.07 |
| T/A (°) | 40 | 41 | 43 | 44 | 44 | 45 | 47 |
| Mo residue | A | A | A | A | A | A | A |
| Mo undercutting | A | A | A | B | B | B | C |

AMP: 2-amino-2-methyl-1-propanol

TABLE 13

| | Example 66 | Example 67 | Example 68 | Example 69 | Example 70 | Example 71 |
|---|---|---|---|---|---|---|
| (A) Hydrogen peroxide (wt %) | 10 | 10 | 10 | 10 | 10 | 10 |
| (B) Malonic acid (wt %) | 5 | 5 | 5 | 5 | 5 | 5 |
| Succinic acid (wt %) | 6.5 | 6.5 | 6.5 | 6.5 | 6.5 | 6.5 |
| (C) AMP (wt %) | 9.5 | 9.5 | 9.5 | 9.5 | 9.5 | 9.5 |
| (D) TA (wt %) | 0.01 | 0.01 | 0.01 | 0.01 | 0.01 | 0.01 |
| (E) Phenylurea (wt %) | 0.3 | 0.3 | 0.3 | 0.3 | 0.3 | 0.3 |
| Water | Remainder | Remainder | Remainder | Remainder | Remainder | Remainder |
| Copper powder (ppm) | 0 | 2000 | 4000 | 6000 | 8000 | 10000 |
| pH | 4.1 | 4.1 | 4.2 | 4.2 | 4.2 | 4.3 |
| Cu film thickness/Mo film thickness (Å/Å) | 5500/300 | 5500/300 | 5500/300 | 5500/300 | 5500/300 | 5500/300 |
| JET (sec) | 70 | 70 | 70 | 70 | 70 | 70 |
| S/E (μm) | 1.35 | 1.28 | 1.31 | 1.18 | 1.15 | 1.05 |
| T/A (°) | 35 | 42 | 44 | 47 | 45 | 41 |
| Mo residue | A | A | A | A | A | A |
| Mo undercutting | A | A | A | A | A | A |

TA: 1,2,4-1H-triazole

TABLE 14

| | Example 72 | Example 73 | Example 74 | Example 75 | Example 76 | Example 77 |
|---|---|---|---|---|---|---|
| (A) Hydrogen peroxide (wt %) | 10 | 10 | 10 | 10 | 10 | 10 |
| (B) Malonic acid (wt %) | 5 | 5 | 5 | 5 | 5 | 5 |
| Succinic acid (wt %) | 7 | 7 | 7 | 7 | 7 | 7 |
| (C) AMP (wt %) | 9.5 | 9.5 | 9.5 | 9.5 | 9.5 | 9.5 |
| (D) ATA (wt %) | 0.04 | 0.04 | 0.04 | 0.04 | 0.04 | 0.04 |
| (E) Phenylurea (wt %) | 0.3 | 0.3 | 0.3 | 0.3 | 0.3 | 0.3 |
| Water | Remainder | Remainder | Remainder | Remainder | Remainder | Remainder |
| Copper powder (ppm) | 0 | 2000 | 4000 | 6000 | 8000 | 10000 |
| pH | | | | | | |
| Cu film thickness/Mo film thickness (Å/Å) | 5500/300 | 5500/300 | 5500/300 | 5500/300 | 5500/300 | 5500/300 |
| JET (sec) | 70 | 70 | 70 | 70 | 70 | 70 |
| S/E (μm) | 1.14 | 1.12 | 1.07 | 1.06 | 1.02 | 1.09 |
| T/A (°) | 49 | 53 | 53 | 51 | 47 | 41 |
| Mo residue | A | A | A | A | A | A |
| Mo undercutting | A | A | A | A | A | A |

ATA: 3-amino-1H-1,2,4-triazole

The S/E of etching solution compositions containing ATZ of Table 12 decreased greatly in response to an increase in the amount of copper dissolved, but the S/E of etching solution compositions containing 1,2,4-1H-triazole of Table 13 decreased slightly, and the S/E of etching solution compositions containing 3-amino-1H-1,2,4-triazole of Table 14 hardly changed. Furthermore, only for the etching solution compositions containing ATZ, Mo undercutting started to occur when the amount of copper dissolved was 3000 ppm.

The main reason for the decrease in S/E was a decrease in the solubility of copper or molybdenum in the etching solution composition; it was necessary to add a replenisher solution in order to maintain the performance in response to an increase in the amount of copper dissolved or to exchange all of the solution while the amount of copper dissolved was still low, but since Mo undercutting did not occur even when the amount of copper dissolved was 10000 ppm, in particular for the etching solution composition containing 1,2,4-1H-triazole or the etching solution composition containing 3-amino-1H-1,2,4-triazole, even when the number of substrates to be treated increases, it is easy to maintain the performance, and it is unnecessary to use a replenisher solution, thus giving many advantages such as the cost being cut.

INDUSTRIAL APPLICABILITY

The etching solution composition of the present invention can be suitably used in the etching of a metal laminate film that contains a layer formed from copper or an alloy having copper as a main component and a layer formed from molybdenum or an alloy having molybdenum as a main component, and the etching method employing the composition enables batch etching of the metal laminate film to be carried out, undercutting of the molybdenum layer to be suppressed, and the cross-sectional shape to be controlled, thus enabling high productivity to be achieved. Furthermore, since the method for extending the life span of the etching composition of the present invention improves the solubility for copper, not only can the life span of the solution be extended, but it is also possible to cut the solution replacement operation and manpower cost and, furthermore, to improve the safety.

The invention claimed is:

1. A method for batch etching a metal laminate film comprising a layer formed from copper or an alloy having copper as a main component and a layer formed from molybdenum or an alloy having molybdenum as a main component, the method comprising a step of carrying out etching using an etching solution composition comprising hydrogen peroxide, an organic acid, an amine compound, an azole, a hydrogen peroxide stabilizing agent, and a step of adding to the etching solution composition that has been used in etching an organic acid and at least one selected from the group consisting of a phosphonic acid-based chelating agent, an alcohol-based solvent, a diol-based solvent, a triol-based solvent, a ketone-based solvent, a nitrogen-containing five-membered ring-based solvent, and a sulfoxide-based solvent, and wherein the etching solution does not contain an inorganic acid.

2. The method according to claim 1, wherein it is used in a production process or a packaging process for any one of a liquid crystal display, a color film, a touch panel, an organic EL display, an electronic paper, a MEMS, and an IC.

* * * * *